US005878613A

United States Patent [19]

Tabacchi et al.

[11] Patent Number: 5,878,613

[45] Date of Patent: Mar. 9, 1999

[54] KEY RETAINING LOCK BOX

[75] Inventors: Octavio Tabacchi, Littleton; Thomas D. Liston, Aurora, both of Colo.

[73] Assignee: Secure Concepts, Ltd., Englewood, Colo.

[21] Appl. No.: 966,431

[22] Filed: Nov. 7, 1997

Related U.S. Application Data

[60] Provisional application No. 60/054,998 Aug. 6, 1997.

[51] Int. Cl.[6] ..... B65D 55/14; E05B 65/52; E05B 11/00

[52] U.S. Cl. ..... 70/389; 70/DIG. 63; 70/63

[58] Field of Search ..... 70/389, 390, 63, 70/61, DIG. 63, 429

[56] References Cited

U.S. PATENT DOCUMENTS

| | | | |
|---|---|---|---|
| Re. 30,198 | 1/1980 | Oliver et al. | 70/364 |
| 2,013,027 | 9/1935 | Branch | 206/38 |
| 2,064,474 | 12/1936 | Hopkins | 177/360 |
| 2,220,786 | 11/1940 | Grainger | 70/262 |
| 2,336,936 | 12/1943 | Johnson . | |
| 2,762,216 | 9/1956 | Wasson . | |
| 3,292,401 | 12/1966 | Van Meter | 70/459 |
| 3,418,833 | 12/1968 | Kerr | 70/389 |
| 3,898,825 | 8/1975 | Taylor | 70/456 |
| 3,979,934 | 9/1976 | Isenmann | 70/459 |
| 4,091,646 | 5/1978 | Sugimoto | 70/456 |
| 4,107,967 | 8/1978 | Grabb | 70/427 |
| 4,109,496 | 8/1978 | Alleman et al. | 70/380 |
| 4,248,071 | 2/1981 | Kussoy | 70/456 |
| 4,315,420 | 2/1982 | Oliver | 70/379 |
| 4,448,051 | 5/1984 | Neilsen | 70/389 |
| 4,472,952 | 9/1984 | Hollowell | 70/61 |
| 4,516,776 | 5/1985 | Nicholas | 273/146 |
| 4,567,741 | 2/1986 | Trempala | 70/389 |
| 4,641,505 | 2/1987 | Maurice | 70/63 |
| 4,753,092 | 6/1988 | Mercer | 70/389 |
| 4,942,748 | 7/1990 | McGough | 70/389 |
| 4,984,442 | 1/1991 | Benson | 70/456 |
| 5,020,347 | 6/1991 | Logan | 70/389 |
| 5,372,021 | 12/1994 | Smith | 70/63 |
| 5,505,066 | 4/1996 | Baucom | 70/389 |
| 5,737,947 | 4/1998 | Ling | 70/63 |

FOREIGN PATENT DOCUMENTS 2 045 855 11/1980 United Kingdom .

*Primary Examiner*—Darnell M. Boucher
*Attorney, Agent, or Firm*—Sheridan Ross P.C.

[57] ABSTRACT

A key control device comprises an access key and lock, and a stored key and lock. The access lock operably receives the access key and is keyed such that when the access key is inserted into the access lock, it becomes movable between an access key release state and an access key capture state. The stored lock operably receives the stored key and is keyed such that when the stored key is received by the stored lock it becomes movable between a stored key release state and a stored key capture state. Only one key can be removed at any given time from either lock and such removal locks the other key against removal so that it is retained by the key control device. The access and stored lock are totally independent and not interconnected in any way.

13 Claims, 9 Drawing Sheets

KEY RETAINING LOCK BOX

CROSS-REFERENCE TO RELATED APPLICATIONS

The present application claims priority from U.S. Provisional Patent Application entitled "Key Retaining Lock Box" by Thomas K. Liston, having Ser. No. 60/054,998, filed Aug. 6, 1997, which is incorporated fully herein by reference.

FIELD OF THE INVENTION

The present invention relates generally to access control systems for keys and other items and specifically to a key holding device that controls access to a key contained inside the device.

BACKGROUND OF THE INVENTION

Organizations, such as automobile dealerships, building maintenance firms, real estate companies, and automotive garages manage numerous locked structures or vehicles. This typically requires coordination and control over the use of many keys among many key users. To protect the keys, a combination-type lock box can be used. The lock box is either secured to the lid of the structure or vehicle or to the window of the vehicle. Typically, lock boxes have a lid which can be removed by anyone having knowledge of the appropriate combination to gain access to the keys.

There are a number of considerations in designing a lock box for such businesses. It would be desirable to have a lock box that requires the master key to be in the box before the box can be reclosed. This would prevent the master key from being misplaced by the user. The lock box should be simple and relatively inexpensive in design. If the lock box were too expensive, it would not be economic for many applications. The lock box should be versatile and employable in a variety of applications without significant modification. The lock box should have a lid that cannot be removed during access to the master key. Misplacement of the lid would cause the entire lock box to be useless.

SUMMARY OF THE INVENTION

These and other design objectives are addressed by the Key holding device of the present invention. The key holding device includes:

(a) a housing defining an enclosure having an interior and including a lid that is movable between an open position allowing access to the interior and a closed position not allowing access to the interior;

(b) an access key;

(c) an access lock mounted to the housing and having an access keyway accessible exteriorly of the housing, (d) a stored key; and (e) a stored lock mounted to the housing and having a stored keyway accessible interiorly of the housing.

The access lock is adapted to operably receive the access key in the access keyway and is keyed such that, when the access key is received in the access keyway, the access lock becomes movable between (i) an access key release state in which the access key is insertable into and removable from the access keyway and (ii) an access key capture state in which the access key is retained within the access keyway of the access lock.

The stored lock is adapted to operably receive the stored key in the stored keyway and is keyed such that, when the stored key is received in the stored keyway, the stored lock becomes movable between (i) a stored key release state in which the stored key is insertable into and removable from the stored keyway and (ii) a stored key capture state in which the stored key is retained within the stored keyway of the stored lock.

The access and stored locks move independently of one another such that, when the access lock moves, the stored lock remains stationary and, when the stored lock moves, the access lock remains stationary. When the access lock is moved to the access key capture state and the lid is in the open position, the stored lock is movable from the stored key capture state to the stored key release state to release the stored key. When the access lock is moved to the access key release state and the lid is in the closed position, the stored lock is not movable from the stored key capture state.

In one embodiment, the independent operability of the stored and access locks results from the locks not being connected by a mechanical drive. Rather, the access lock includes an access cam that is movable with the access lock and the stored lock includes a stored cam that is movable with the stored lock. The lid includes an access slot to engage the end of the access cam when the access lock is in the access key release state, and a stored slot to engage the end of the stored cam when the stored lock is in the stored key release state. Thus, when the stored key is in the stored key capture state, the stored cam is free of contact with the stored slot, and, when the access key is in the access key capture state, the access cam is free of contact with the access slot. In this manner, when the access key is in the access key release state, the stored key is fixed in the stored key capture state and, when the stored key is in the stored key release state, the access key is fixed in the access key capture state.

The operation of the key holding device is relatively simple. The method includes the steps of:

(a) inserting the access key in the access lock;

(b) moving the access key and the access lock to the access key capture state to unlock the lid from the closed position;

(c) after the access key is in the access key capture state, moving the lid to the open position to expose the stored key in the stored lock; and (d) thereafter moving the stored key from the stored key capture state to the stored key release state to lock the lid in the open position. In this way, the stored key and any item attached to the stored key can be removed from the stored lock.

After step (d) the method can include further steps. For example, the method can include the step of reinserting the stored key in the stored lock, moving the stored key to the stored key capture state (thereby unlocking the lid from the open position) and thereafter moving the lid to the closed position. After the lid is in the closed position, the access key can be moved to the access key release state to relock the lid in the closed position. The access key can thereafter be removed from the access lock.

The key holding device of the present invention can have several benefits relative to existing devices. The key holding device is simple, inexpensive and eliminates intensive human monitoring. Another advantage is that the locks are not interconnected, but may rotate independently, eliminating the possibility of mechanical binding or catching such as with a typical tie-rod connection. The device is versatile and is employable in a variety of applications without significant modification.

DETAILED DESCRIPTION

Figure 1:
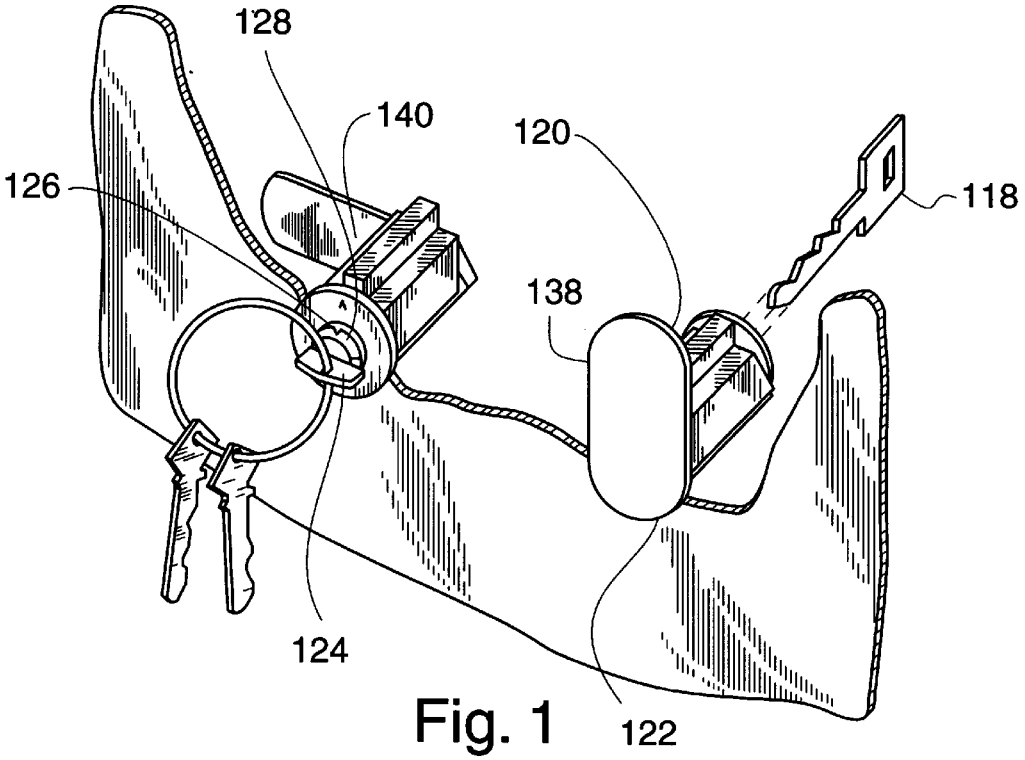
FIG. 1 is an isometric view of an access lock in an access key release state.

With reference to FIGS. 1–6, an embodiment of the present invention is depicted. The key holding device 110 includes a stored lock 126 having a stored cam 140, an access lock 120 having an access cam 138, a stored key 124, an access key 118, and a housing enclosure 112. The housing enclosure 112 has an interior 114, a top lock plate 146, and a movable sliding lid 116 with beveled edges 117 (extending on either side of the lid) that slide into corresponding grooves 119 on either side of the housing.

Figure 2:
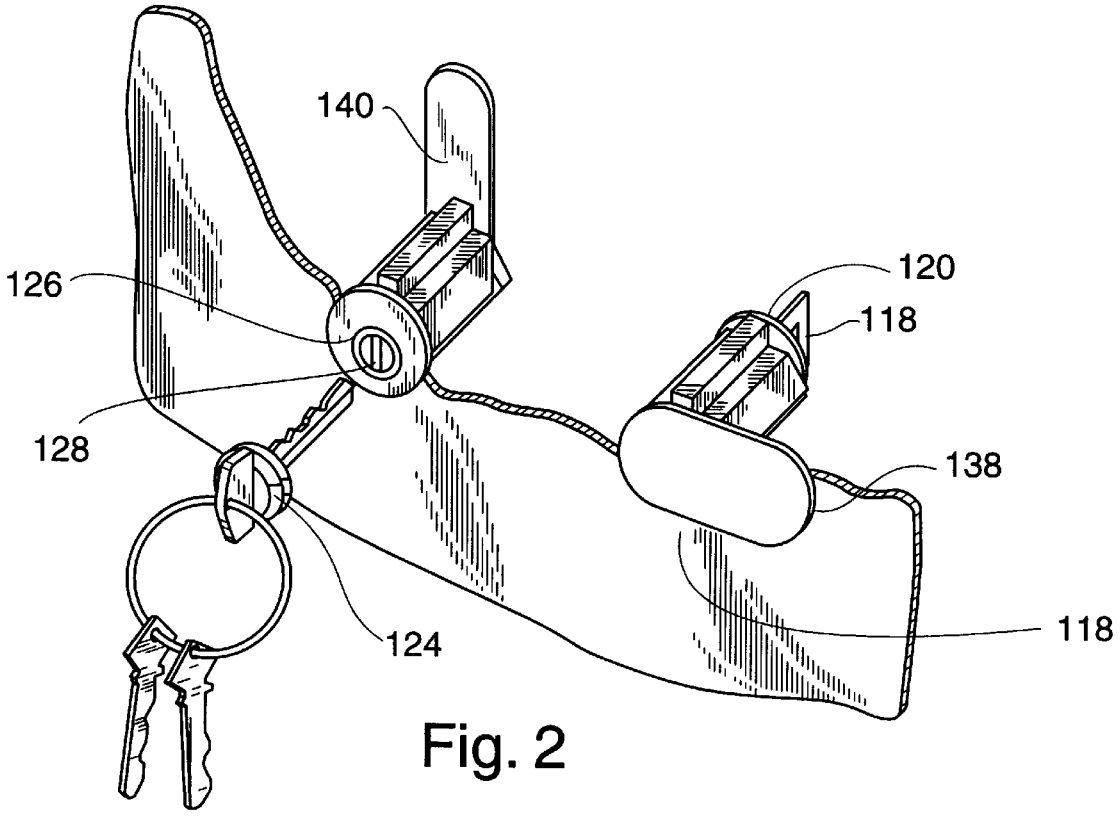
FIG. 2 is an isometric view of a stored lock in a stored key release state.
Figure 3A:
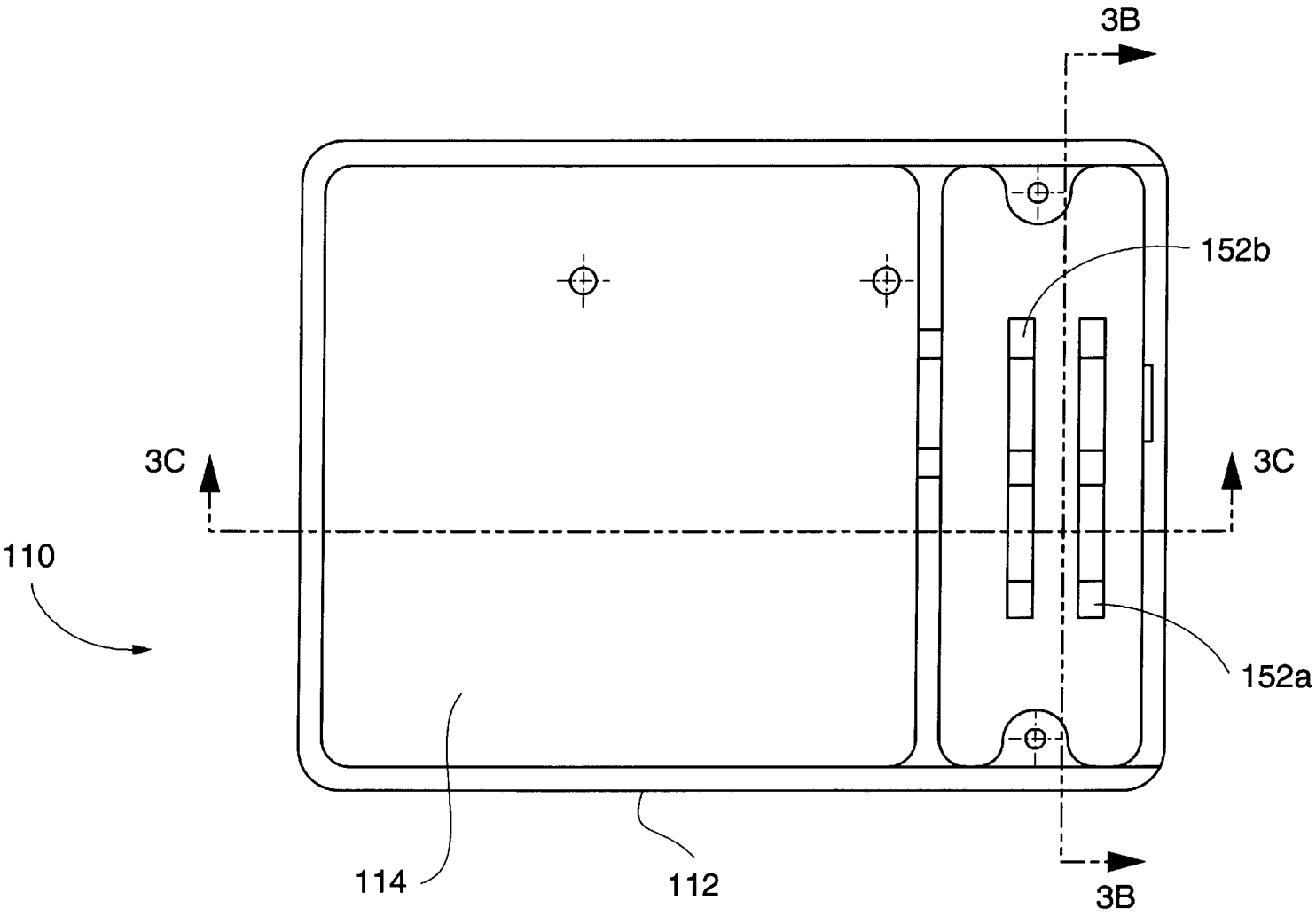
FIG. 3A is a top view of a housing enclosure in a preferred embodiment of the present invention.
Figure 3B:
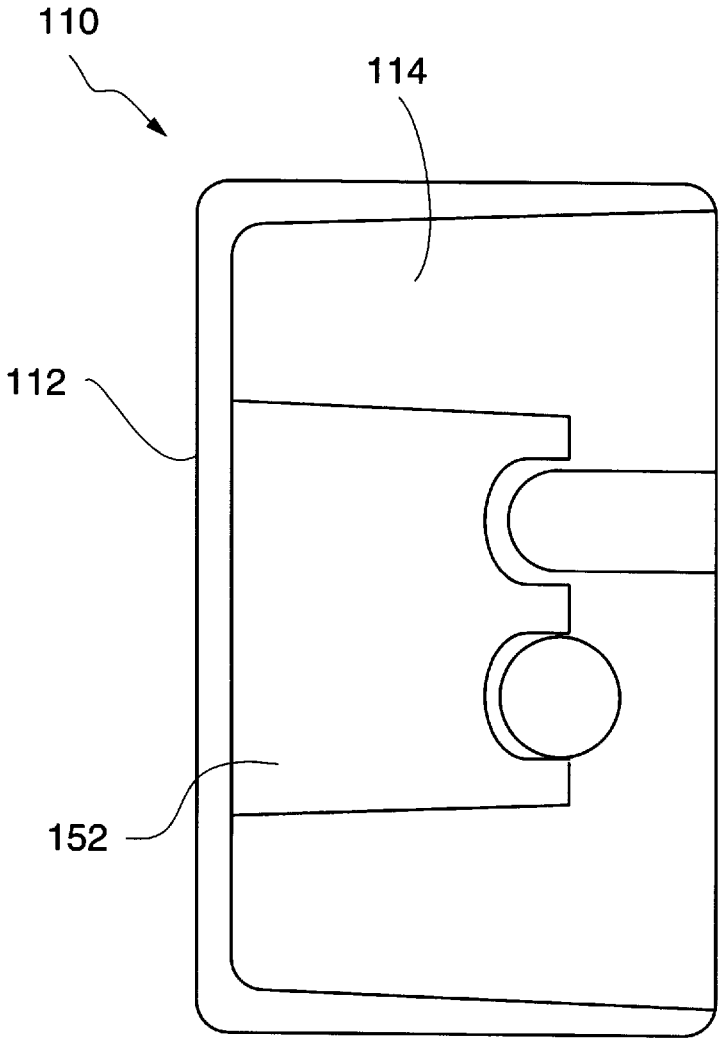
FIG. 3B is a sectional view of the housing enclosure taken along line 3B—3B of FIG. 3A.
Figure 3C:
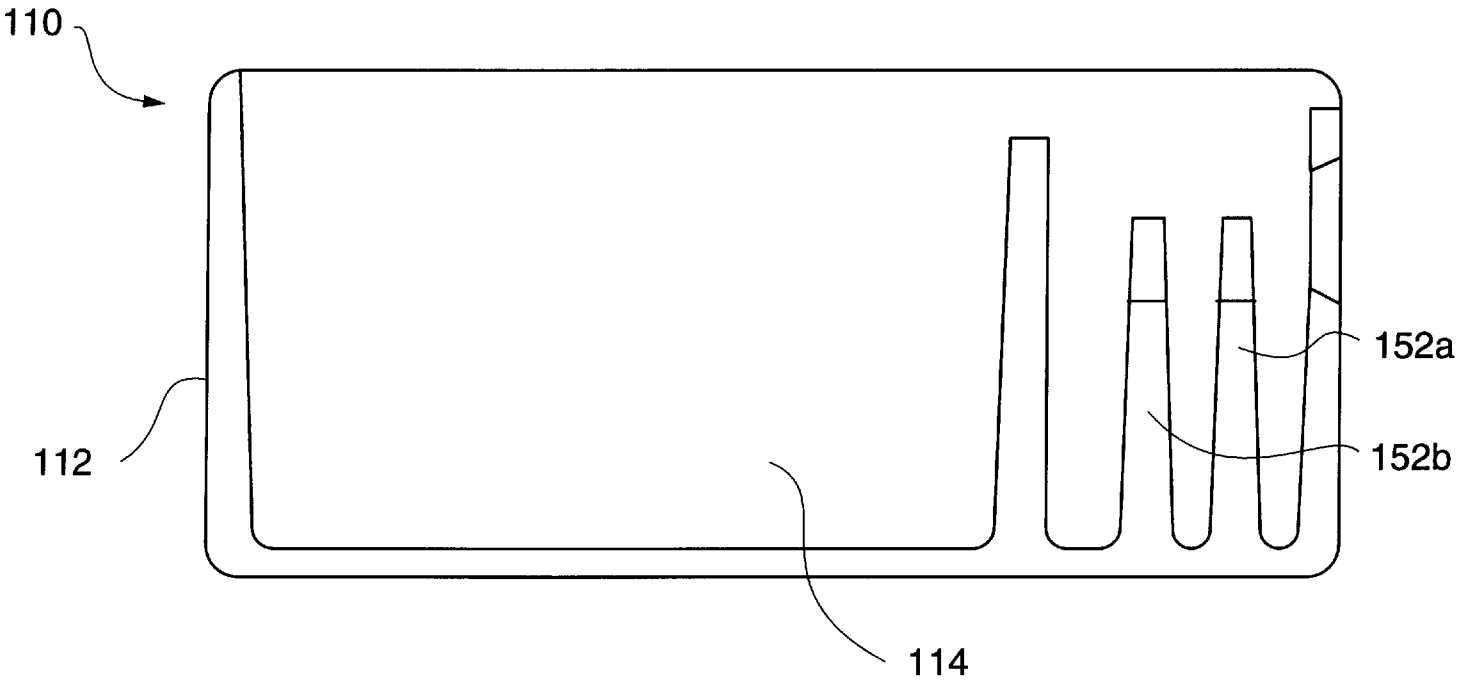
FIG. 3C is a sectional view of an embodiment of the housing enclosure taken along line 3C—3C of FIG. 3A.

The access key 118 is inserted into the access keyway 122 of the access lock 120 to move the access lock 120 from the access key release state (in which the access key is removable from the access keyway) (FIG. 1) to the access key capture state (in which the access key is not removable from the access keyway) (FIG. 2). The access keyway 122 is accessible from the exterior of the housing enclosure 112. The body of the access lock 120 is mounted to the dual walled common support structure 152a,b of the housing enclosure 112.

The stored lock 126 is also mounted to the dual walled common support structure 152 of the housing enclosure 112 and, like the access lock, has both a stored key release state and a stored key capture state. In the stored key release state (FIG. 2), the stored key is removable from the stored keyway 128 (which is accessible interiorly of the housing enclosure 112). In the stored key capture state (FIG. 1), the stored key is not removable from the stored keyway 128.

As can be seen in FIGS. 1 and 2, the access lock 120 with the access cam 138 and the stored lock 126 with the stored cam 140 move independently of one another such that when the access lock 120 moves, the stored lock 126 remains stationary, and when the stored lock 126 moves, the access lock 120 remains stationary.

Figure 4:
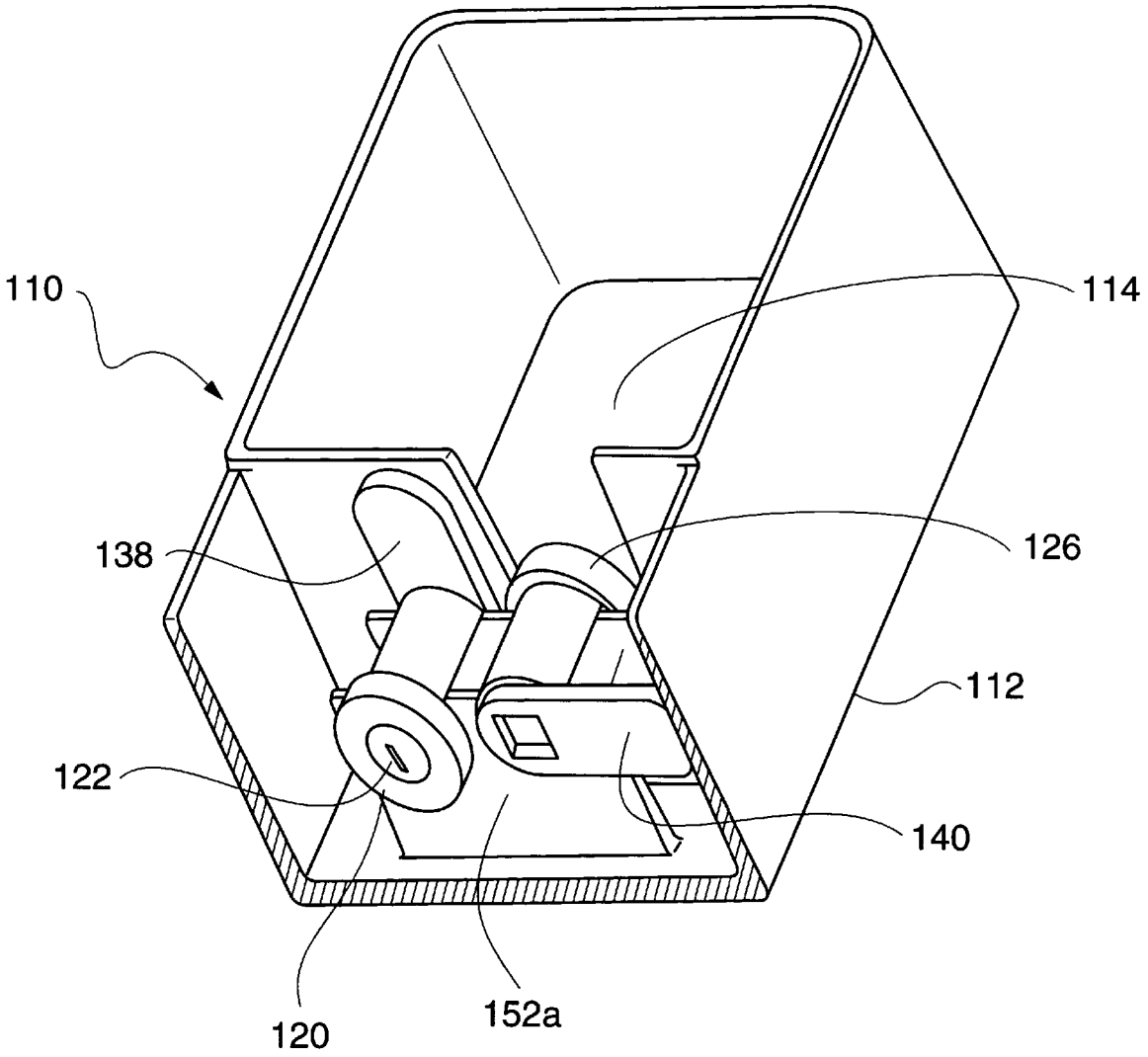
FIG. 4 is an isometric view of the preferred embodiment of this invention, with the access and stored locks oriented in opposing directions.
Figure 5:
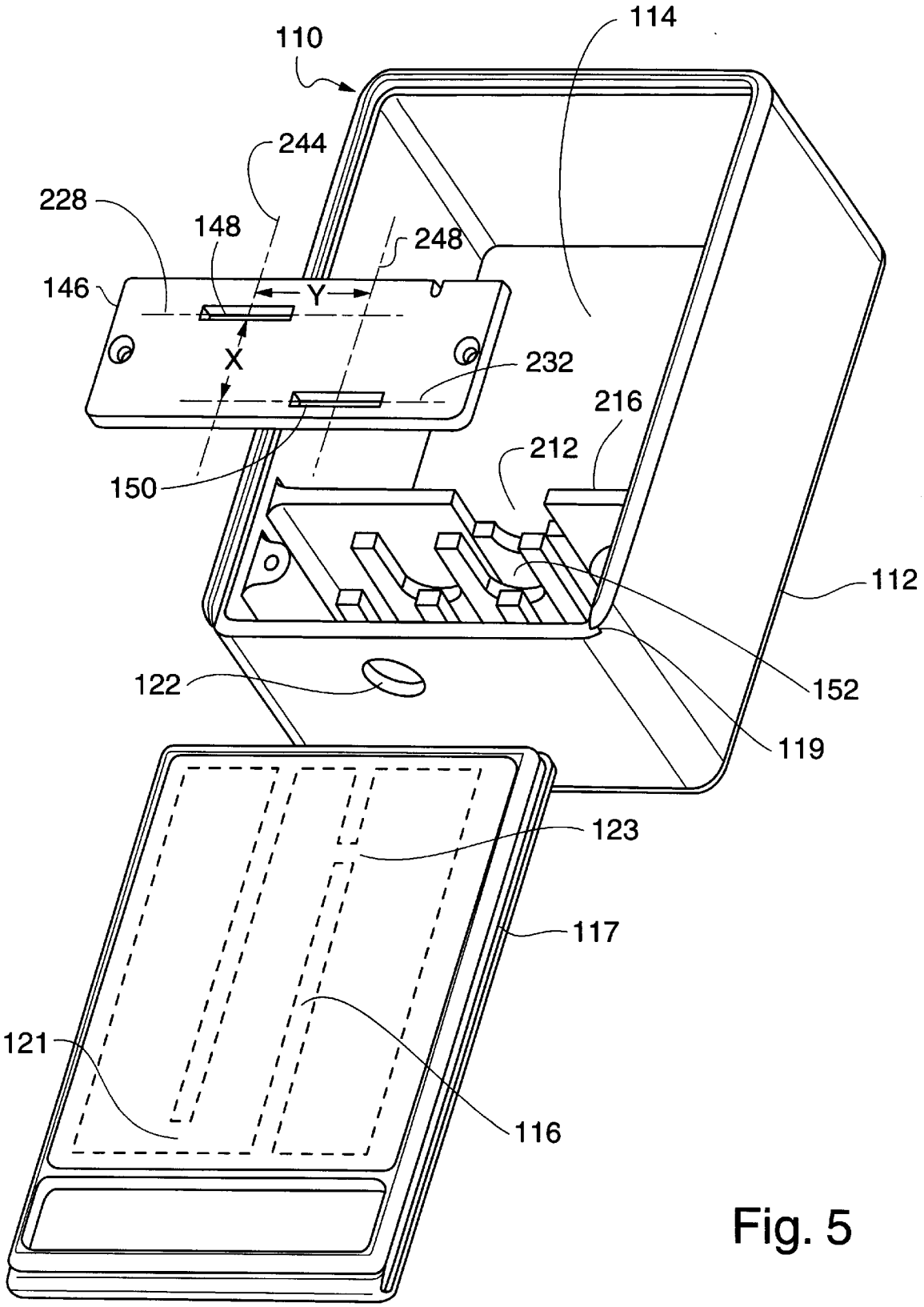
FIG. 5 is an isometric view of the preferred embodiment showing a housing enclosure with the lid.

Referring to FIGS. 4 and 5, the locking and unlocking of the lid in open and closed positions is illustrated. When the access lock is in the access key release state, the access cam 138 engages an access cam groove 121 in the lid and thereby locks the lid in the closed position. When the access lock 120 is disengaged from the access cam groove 121 (and therefore the lid) and moved to the access key capture state, the access cam 138 is retracted into an interior 114 of the housing 112, and the movable sliding lid 116 is movable to the open position. When the lid is moved to the open position, the stored lock 126 is movable from the stored key capture state (in which the stored cam is retracted into the interior of the housing enclosure and therefore does not contact the lid) to the stored key release state (in which the stored cam engages a stored cam groove 123) for the purpose of releasing the stored key 124. When the stored key is in the stored key release state, the stored cam 140 is in an extended position and engaged with the stored cam groove 123 in the lid 116, thereby locking the lid in the open position. When the movable sliding lid 116 is locked in the closed position, the items stored in an interior 114 of the housing 112 can not be reached.

The lid 116 thus imposes limitations on the freedom of movement of the stored and access locks. When the stored lock 126 is moved to the stored key release state and the movable sliding lid 116 is in the open position, the access lock 120 is not movable from the access key capture state because the access cam cannot engage the access cam groove in the lid. When the access lock 120 is moved to the access key release state and the lid is in the closed position, the stored lock 126 is not movable from the stored key capture state because the stored cam cannot engage the stored cam groove in the lid.

Referring to FIGS. 5 and 8A–D to permit the access cam 138 and stored cam 140 to engage, respectively, the access cam groove 121 and the stored cam groove 123, the top lock plate 146 has an access cam hole 148 and a stored cam hole 150. The access cam hole 148 corresponds with the access cam while the stored cam hole 150 corresponds with the stored cam. With reference to FIGS. 8A–D, the top lock plate 146 further includes an access lock ridge 200 to retain the access lock in position, a stored lock ridge 204 to hold the stored lock in position, and a stored lock holder 208 in a stored slot 212 in an interior wall 216 of the housing enclosure 112 to secure the top lock plate and the stored lock in position.

Because the latitudinal center axes 220 and 224 of the access cam and stored cam are offset from one another by a distance "X" (see FIG. 7), the latitudinal center axes 228 and 232 of the stored cam hole 150 and the slot cam hole 148 are also offset from one another by the distance "X". Because the longitudinal center axes 236 and 240 of the access lock and stored lock are offset from one another by a distance "Y" (FIG. 7), the traverse center axes 244 and 248 of the stored cam hole and the slot cam hole are also offset from one another by the distance "Y".

Figure 6A:
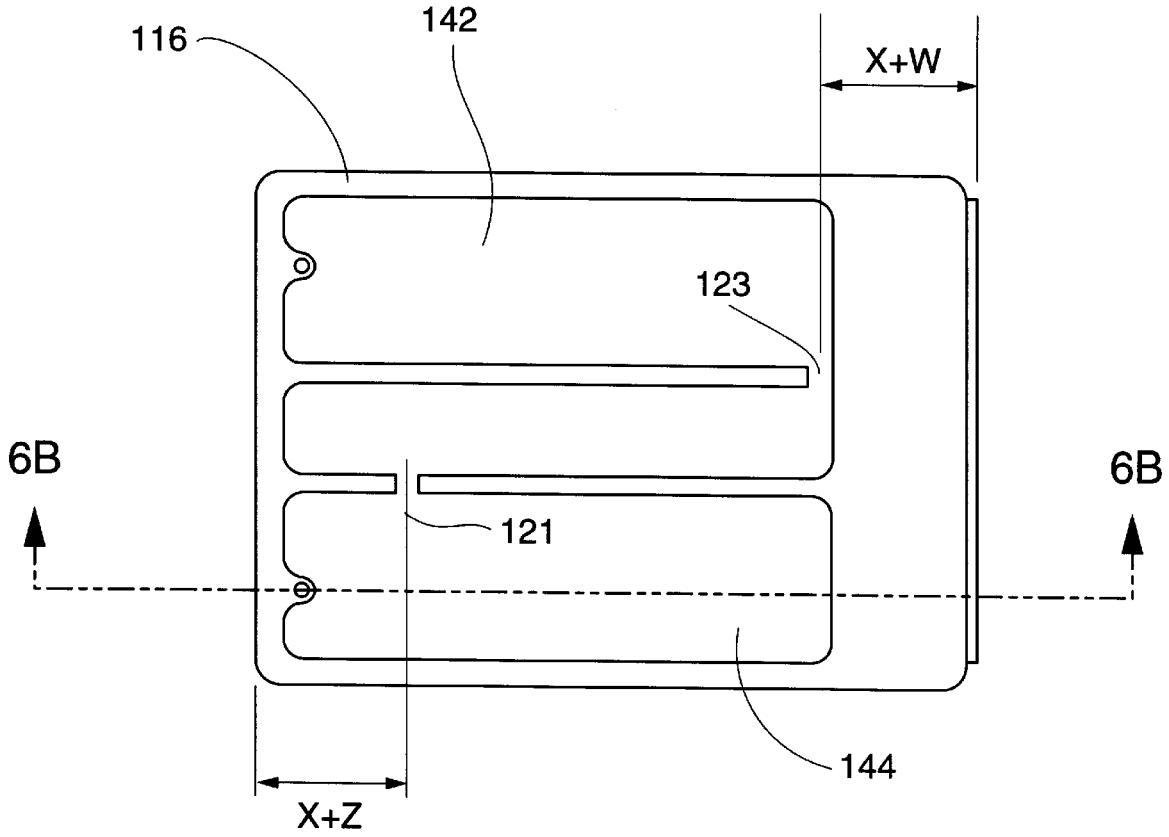
FIG. 6A is a top view of the lid.
Figure 6B:
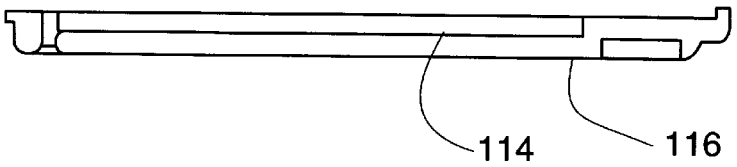
FIG. 6B side view of the lid.
Figure 7:
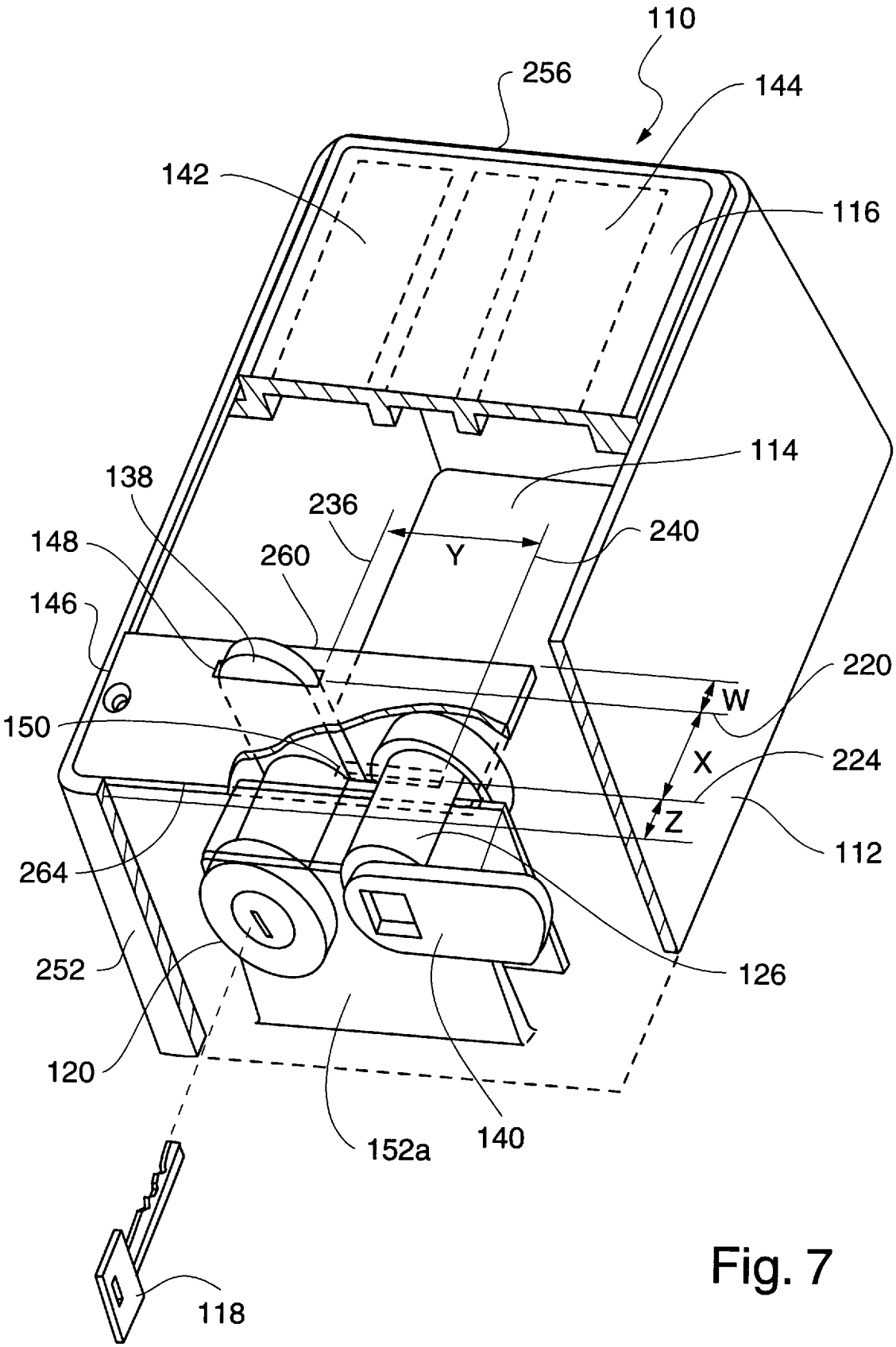
FIG. 7 is an isometric view of the preferred embodiment of this invention, with the access lock oriented and protruding through the access cam hole of the top lock plate, and the movable sliding lid in the locked position.
Figure 8A:
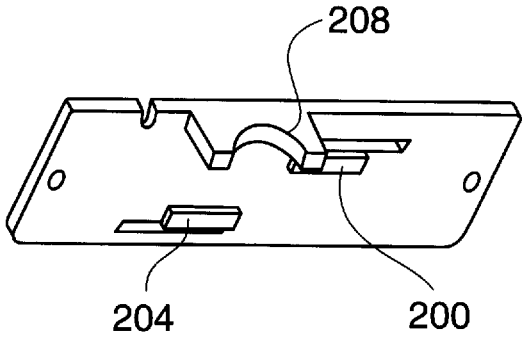
FIGS. 8A–D are various views of the top lock plate.
Figure 8B:
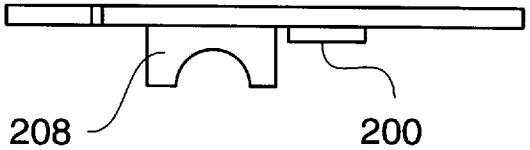
Figure 8C:
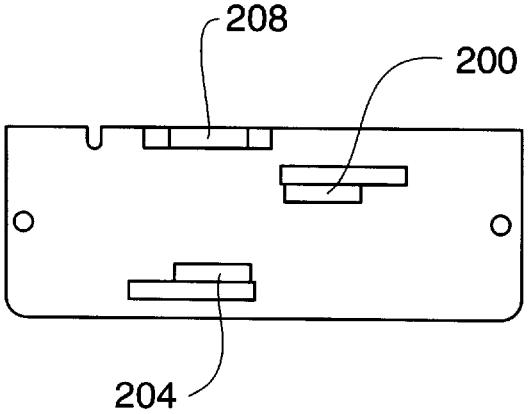
Figure 8D:
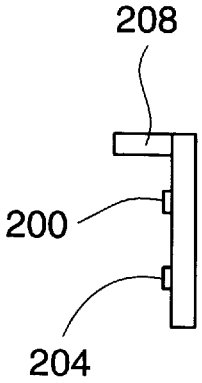

With reference to FIG. 6A and 7, the relative locations of the access and stored cam grooves and the access and stored cams are depicted. The distance of the latitudinal center axes of the stored cam to the near end 252 of the housing enclosure 112 is "Z". When the lid 116 is in the open position (and therefore the stored lock is in the stored key release state), the stored cam must be capable of engaging the stored cam groove. Accordingly, the distance of the stored cam groove 123 from the far end 256 of the lid 116 is X+W. The distance of the access cam to the interior side 260 of the top lock plate is "W". When the access lock is in the access key release state, the access cam must be capable of engaging the access cam slot. Accordingly, the distance of the access slot 121 from the near end 264 of the lid is X+Z.

The operation of the key holding device 110 will now be described. As previously discussed, any item of the proper size can be stored in the housing enclosure 112, when the movable sliding lid 116 is in the open position, by inserting such an item into an interior 114, inserting the stored key in the keyway of the stored lock, moving the stored lock from the stored key release state to the stored key capture state, closing the movable sliding lid 116 of the housing enclosure 112, moving the access key from the access key capture state to the access key release state, and removing the access key from the access keyway in the access lock. For example, a car key may be attached to the stored key 124 and locked into the housing 112 when the movable sliding lid 116 is in the closed position. To retrieve the item, the access lock is reinserted in the access keyway, the access lock is moved to the access key capture state, the lid is moved to the open position, the stored lock is moved to the stored key release state, and the stored key (and the attached item) is removed from the stored keyway.

While the above description only shows one embodiment of an invention, it is not limited thereto since one may make modifications, and other embodiments of the principles of this invention will occur to those skilled in the art to which this invention pertains, particularly upon considering the foregoing teachings.

What is claimed is:

1. A key holding device comprising:

(a) a housing defining an enclosure having an interior and including a lid movable between an open position allowing access to the interior and a closed position;

(b) an access key;

(c) an access lock mounted to the housing and having an access keyway accessible exteriorly of said housing, the access lock adapted to operably receive the access key in the access keyway thereof and keyed such that, when the access key is received in the access keyway, the access lock becomes movable between an access key release state wherein the access key is insertable into and removable from the access keyway and an access key capture state wherein the access key is retained within the access keyway of the access lock;

(d) a stored key; and (e) a stored lock mounted to the housing and having a stored keyway accessible interiorly of the housing, the stored lock adapted to operably receive the stored key in the stored keyway thereof and keyed such that, when the stored key is received therein, the stored lock becomes movable between a stored key release state wherein the stored key is insertable into and removable from the stored keyway and a stored key capture state wherein the stored key is retained within the stored keyway of the stored lock and wherein the access and stored locks move independently of one another such that when the access lock moves, the stored lock remains stationary and when the stored lock moves, the access lock remains stationary, whereby, when the access lock is moved to the access key capture state and the lid is in the open position, the stored lock is movable from the stored key capture state to the stored key release state to release the stored key and, when the access lock is moved to the access key release state and the lid is in the closed position, the stored lock is not movable from the stored key capture state.

2. The key holding device of claim 1, wherein the access lock comprises an access cam that is movable with the access lock and the stored lock comprises a stored cam that is movable with the stored lock.

3. The key holding device of claim 2, wherein the lid comprises an access slot to engage the access cam when the access lock is in the access key release state.

4. The key holding device of claim 2, wherein the lid comprises a stored slot to engage the stored cam when the stored lock is in the stored key release state.

5. The key holding device of claim 2, wherein the lid comprises a stored slot to engage the stored cam when the stored lock is in the stored key release state and the lid comprises an access slot to engage the access cam when the access lock is in the access key release state and wherein, when the stored key is in the stored key capture state and the access key is in the access key release state, the stored cam is free of contact with the stored slot while the access cam is in contact with the access slot and wherein, when the access key is in the access key capture state and the stored key is in the stored key release state, the access cam is free of contact with the access slot while the stored cam is in contact with the stored slot.

6. The key holding device of claim 1, wherein, when the access key is in the access key release state, the stored key is fixed in the stored key capture state and wherein, when the stored key is in the stored key release state, the access key is fixed in the access key capture state.

7. A key holding device comprising:

(a) a housing defining an enclosure having an interior and including a lid movable between an open position allowing access to the interior and a closed position;

(b) an access key;

(c) an access lock mounted to the housing and having an access keyway accessible exteriorly of said housing and an access cam that moves with the access lock, the access lock adapted to operably receive the access key in the access keyway thereof and keyed such that, when the access key is received in the access keyway, the access lock becomes movable between an access key release state wherein the access key is insertable into and removable from the access keyway and an access key capture state wherein the access key is retained within the access keyway of the access lock;

(d) a stored key; and (e) a stored lock mounted to the housing and having a stored keyway accessible interiorly of the housing and a stored cam that moves with the stored lock, the stored lock adapted to operably receive the stored key in the stored keyway thereof and keyed such that, when the stored key is received therein, the stored lock becomes movable between a stored key release state wherein the stored key is insertable into and removable from the stored keyway and a stored key capture state, wherein (I) in the access key capture state, the access cam is free from contact with the lid and the stored cam is in contact with the lid and (ii) in the access key release state, the access cam is in contact with the lid and the stored cam is free from contact with the lid.

8. The key holding device of claim 7, wherein the access and stored locks move independently of one another such that when the access lock moves, the stored lock remains stationary and when the stored lock moves, the access lock remains stationary, whereby, when the access lock is moved to the access key capture state and the lid is in the open position, the stored lock is movable from the stored key capture state to the stored key release state to release the stored key and, when the access lock is moved to the access key release state and the lid is in the closed position, the stored lock is not movable from the stored key capture state.

9. A method for storing an item contained in an enclosure, the enclosure having a lid movable between an open position and a closed position, comprising:

(a) inserting an access key in an access lock, the access lock engaging the housing;

(b) moving the access key in the access lock to an access key capture state in which the access key is retained within the access lock;

(c) after the access key is in the access key capture state, moving the lid to the open position to expose a stored key in a stored lock, the stored lock being positioned within the enclosure, the stored key being in a stored key capture state in which the stored key is retained within the stored lock; and (d) thereafter moving the stored key to a stored key release state in which the stored key is insertable into and removable from the stored lock.

10. The method of claim 9, further comprising after step (d):

(e) moving the stored key to a stored key capture state in which the stored key is retained in the stored lock.

11. The method of claim 10, further comprising after step (e):

(f) moving the lid to the closed position.

12. The method of claim 11, further comprising after step (f):

(g) moving the access key to an access key release state in which the access key is insertable into and removable from the access lock.

13. The method of claim 11, further comprising after step (f):

(g) moving the access key in the access lock to place the lid in a locked position.

* * * * *